United States Patent [19]

Leas

[11] 4,008,145

[45] Feb. 15, 1977

[54] CONVERTING SOLID FUELS TO GASEOUS AND LIQUID FUELS

[76] Inventor: Arnold Marcel Leas, 115 S. Line St., Columbia City, Ind. 46725

[22] Filed: May 14, 1975

[21] Appl. No.: 577,504

[52] U.S. Cl. ..... 208/8; 208/11 LE

[51] Int. Cl.[2] ..... C10G 1/04

[58] Field of Search ..... 208/8, 10, 11

[56] References Cited

UNITED STATES PATENTS

| | | | |
|---|---|---|---|
| 3,503,867 | 3/1970 | Ludlam et al. | 208/8 |
| 3,533,938 | 10/1970 | Leas | 208/8 |
| 3,617,464 | 11/1971 | Johnson | 208/8 |
| 3,715,301 | 2/1973 | Tassoney et al. | 208/8 |
| 3,736,111 | 5/1973 | Gardner et al. | 208/8 |
| 3,769,197 | 10/1973 | Leas et al. | 208/8 |
| 3,779,893 | 12/1973 | Leas et al. | 208/10 |
| 3,790,467 | 2/1974 | Fiocco et al. | 208/8 |

*Primary Examiner*—Herbert Levine
*Assistant Examiner*—James W. Hellwege
*Attorney, Agent, or Firm*—Edward E. Dyson; John J. Byrne

[57] ABSTRACT

A process for producing gaseous and liquid fuels from solid fuels by oil extraction, cracking in the presence of hot sand and treatment of products and byproducts to essentially eliminate pollution.

6 Claims, 1 Drawing Figure

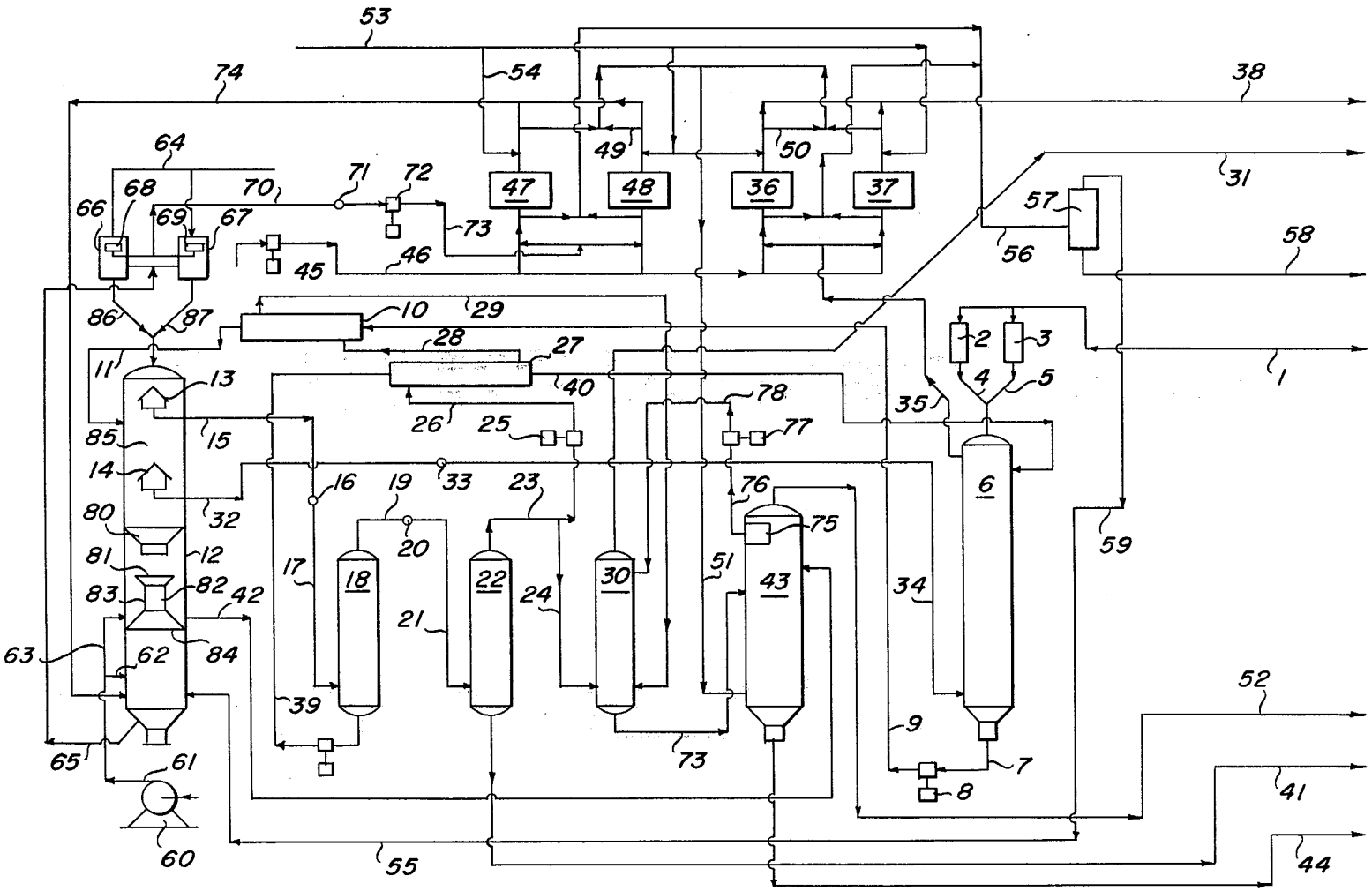

CONVERTING SOLID FUELS TO GASEOUS AND LIQUID FUELS

This invention relates to energy production. More particularly, this invention relates to a method and apparatus for converting solid fuels into gaseous and liquid clean fuels.

It is quite desirable from an economic standpoint to utilize such solid fuels as coal, shale oil, municipal and agricultural solid wastes, char, coke, charcoal and the like to produce both gaseous and liquid fuels since such sources are relatively inexpensive compared to petroleum crude oil, and are quite abundant in contrast to the rapidly dwindling supplies of petroleum and natural gas resources.

The prior art processes and apparatus for recovering gaseous and liquid fuels from such sources as coal, solid waste or the like are quite complicated and inefficient, with the operations thereof misproportioned, with the result that the production of gaseous and liquid fuels from such sources is not commensurate with the expenditures involved. Additionally, and particularly when utilizing coal as the source of liquid and gaseous fuels, substantial impurities or pollutants are encountered, such as sulfur, which must be removed in order to produce clean liquid and gaseous products.

It is an object of the present invention to provide a relatively simple and economically feasible process for recovering gaseous and liquid fuel values from solid fuel sources.

It is a further object of the present invention to convert any grade of coal into a maximum yield of liquid fuels and a minor yield of gaseous fuels.

It is also an object of the present invention to minimize oxygen or air requirements in converting solid fuels to liquid and gaseous fuels.

It is a further object of the present invention to provide a process for obtaining gaseous and liquid fuels from solid fuels whereby the emissions are essentially pollution-free.

In accordance with the process of the present invention solid fuel in a crushed or shredded state is conveyed into the top of an oil extractor, where oils are extracted, phenolics, organo-nitrogen compounds and sulfurous materials are decomposed to steam, ammonia and hydrogen sulfide with hydrogen transfer operating to increase the rate of removal of oils from the solid fuel, the hot fuel gases are removed to a unit where the hydrogen sulfide is removed and desulfurized low BTU gas recovered; the solid-oil slurry remaining in the extractor is removed to a hydrocracker where high molecular weight compounds are cracked to lower molecular weight compounds with the thus-treated solid-oil slurry removed to a reactor, admixed with hot, circulating sand with the resultant cracking producing fuel gas, and vaporized diesel and gasoline fuels, with the vaporized fuels filtered and separated, the gasoline fraction further extracted in a fractionator and removed as product, the diesel fraction hydrogenated and returned to the oil extractor for further recycling the higher heat content fuel gas in the solids reactor removed with the vaporized diesel and gasoline fuels is diverted, a portion thereof removed to the diesel hydrogenator and the hydrocracker, with the remainder conveyed to a desulfurization caustic treater and removed from the system.

The solids in the reactor adhere to downwardly flowing hot sand into a gasification zone where the carbon is gasified with steam, oxygen, and carbon dioxide, the ash separated from the sand by the upward force of the gases and collected in annular collection zones at the bottom of the reactor, the sand removed to lower pressure storage or lock-bins for recycling with the carbon dioxide removed and recycled after desulfurization with cobalt oxide, and the ash removed for treatment to remove soluble alkali metals and removed from the system.

FIG. 1 is a diagrammatic illustration of the process of the present invention.

Raw, crushed coal, shredded solid wastes or other solid fuel 1 is conveyed into feed lock-bins 2 and 3. Alternately, the solid fuel is pressured into the top of solid fuel-oil extractor 6 wherein oil is extracted out of the solid fuel by intimate contact with process recycle diesel solvent oil and hydrogen. Phenolics, organo nitrogen compounds and sulfur are decomposed to steam, ammonia and hydrogen sulfide gases, with hydrogen transfer and/or hydrogenation increasing the removal of oil from the solid fuels. Generally, the extraction is carried out at temperatures generally on the order of from about 500° to about 900° F with a residence time of from about 20 to about 60 minutes. A suspended catalytic agent such as cobalt sulfide may be employed to increase the rate of hydrogenation. The treatment of the solid fuel in the extractor is effected in the presence of hydrogenated recycle diesel oil, obtained in a manner described hereinafter. Hydrogen to extractor 6 may be initially supplied from an outside source; however, once the process is initiated, the hydrogen requirements may be essentially satisfied by the recycling of the hydrogen present in the high heat content fuel gas produced in the solids reactor 12.

The top vent gases containing low heat content fuel gas are pressurized from the extractor 6 via line 35 to cobalt treaters 36 and 37 where hydrogen sulfide is removed. In the cobalt treaters 36 and 37 cobalt oxide reacts with the hydrogen sulfide to produce cobalt sulfide to free the gases from sulfur. In operation, gases flow into either 36 or 37 in an alternate fashion, with either 36 or 37 removing sulfur from in-flowing gases while the other treater is being regenerated. In the regeneration cycle, the cobalt sulfide is reacted with steam introduced via line 54 from steam generator 53 and a small amount of air via line 46 from blower 45 in amounts sufficient to convert the cobalt sulfide to cobalt oxide and free or elemental sulfur. The liquid sulfur is pressured by the steam via line 56 to a sulfur disengager 57 and line 58 to storage. The recycle steam then flows from 57 via line 59 and 55 to the bottom of solids reactor 12. The treated low heat content fuel gas from 36 and 37 is pressured from the system via line 38. The treated solids-oil slurry is conveyed from the extractor 6 via lines 7 and 9 with pumping means 8 to hydrocracker 10. In hydrocracker 10 the high molecular weight compounds are broken down to lower molecular weight compounds, generally at temperatures on the order of from about 750° to 950° F and a residence time of from about 5 to 20 minutes. The treated solids-oil slurry is pressured from hydrocracker 10 via line 11 to a solids reactor 12.

Within the solids reactor 12 the solids-oil slurry admixes with hot circulating sand wherein cracking occurs, generally at temperatures on the order of from about 900° to about 1300° F to produce fuel gas and vaporized diesel and gasoline fuels. The vaporized fuels are removed by pressure through filter 13, via line 15 to exchanger 16, line 17 to diesel fractionator 18. In the diesel fractionator separation of the diesel fuel, gasoline fuel and high heat content fuel gas is separated. The diesel fuel is pumped through line 39 to hydrogenator 27, and via line 40 to the solids extractor 6 for further recycling to extinction. The gasoline fuel and high heat content gas is conveyed from fractionator 18 via line 19 through exchanger 20 and to a gasoline fractionator 22 via line 21. The gasoline extracted in fractionator 22 is removed from the system via line 41. The high heat content fuel gas removed from the gasoline fractionator is passed through line 23, and divided, with a minor portion diverted via line 24 to a caustic treater 30, with the main stream of the gas directed to a compressor 25 and transferred via line 26 to the high pressure diesel hydrogenator 27. The fuel gas excess is then pressured via line 28 into the hydrocracker 10 and via line 29 to the caustic treater 30 where the gas is desulfurized. The desulfurized high heat content fuel gas is then removed from the system via line 31.

The hot low heat content fuel gases present in the solids reactor 12 are removed via filter 14, via line 32 to exchanger 33 and line 34 to the bottom of extractor 6 for mixing and treating the solids-oil slurry.

In the solids reactor 12 the carbon adheres to the downwardly flowing hot sand in zone 85 and gravitates downwardly through conical tray 80 into a collecting funnel 81 and to zone 84. In zone 84 the carbon is gasified with steam, air and recycle carbon dioxide with the producer gas flowing upwardly to drive the powdered ash through throat 82 with the ash settling into ash accumulator 83, and removed via line 42 to an aqueous calcium sulfide precipitator tower 43 where soluble alkali metals are removed at 75 via line 76 with pump 77 pressuring regenerated caustic via lines 76 and 78 to the caustic treater 30. The spent caustic which served to dissolve hydrogen sulfide and carbon dioxide from the fuel gas is pressured from treater 30 via line 79 to the regenerator tower 43. The spent-ash slurry water is removed from the system via line 44.

The sand in the solids reactor 12 is decarbonized by air from compressor 60 moving via lines 61, 62 and 63 into the solids reactor at zone 84 and 83.

The decarbonized recycle sand is then pressured from the bottom of the solids reactor 12 via line 65 into the lower pressured lock-bin 66 or 67. The lower pressure lock-bin 66 or 67 permits recycle carbon dioxide to flow through filter 68 or 69 through line 70, exchanger 71, compressor 72 and line 73 to cobalt treaters 47 or 48 wherein sulfur and carbon monoxide are removed in the manner described from cobalt treaters 36 and 37. The chemically super-heated carbon dioxide recycle gas is then pressured via line 74 to the bottom of the solids reactor 12.

The cobalt reagent in cobalt treaters 36, 37, 47 and 48 is regenerated with steam through line 54 as previously described.

The hot clean sand is now returned to the top of the solids reactor via line 86 or 87 in a cyclic, continuous fashion.

The hot nitrogen gas from the cobalt treaters 36, 37, 47, and 48 is removed via lines 49, 50 and 51 to the calcium sulfide precipitator 43 and vented to the atmosphere via line 52.

FIG. 2 is a schematic for the solids reactor filters 13 and 14, which are advantageously employed in the process of the present invention.

Such process is extremely well-suited to the use of coal as the primary feed or source of solid fuel. Admixtures of coal with other solid fuels may also be employed, or the coal may be replaced entirely with such solid fuels as municipal wastes, agricultural wastes or the like. It is to be understood that the use of waste requires the removal therefrom of such noncombustibles as metal, glass, dirt and the like.

Generally, the system is operated at pressures on the order of from about 50 to about 175 psig, with the temperatures within the solids reactor maintained at from about 800° to about 2000° F. The rate of sand circulation may vary according to the size of the unit or the like, generally being on the order of from about two to ten times the coal feed.

Utilizing the process of the present invention 10,000 pounds of coal was treated over a twenty-four hour feed period (9250 pounds moisture free) at 120 psig, a sand circulation rate of 30,000 pounds/day with a maximum temperature in the solids reactors of 1890° F with the following results:

| Products (expressed as heat content of deashed coal) | |
|---|---|
| Gasoline | 38.4% |
| Low BTU gas | 22.5% |
| High BTU gas | 23.8% |
| | 84.7% |
| Elemental sulfur recovered: | 79.0% |
| Carbon content of ash: | 0.8% |
| BTU/cu.ft. - low BTU gas: | 184 |
| BTU/cu.ft. - high BTU gas: | 495 |
| BTU/gal. - gasoline: | 125,610 |

One ton per day of shredded paper wastes were utilized with 10,000 pounds of raw coal at 140 psig, a sand circulation rate of 50,000 lbs/day with a maximum reactor temperature of 1915° F, the following results obtained:

| Products (heat content of deashed coal/paper) | |
|---|---|
| Gasoline | 35.5% |
| Low BTU gas | 24.8% |
| High BTU gas | 23.7% |
| | 83.8% |
| Elemental sulfur recovered: | 76.0% |
| Carbon content of ash: | 0.7% |
| BTU/cu.ft. - low BTU gas | 226 |
| BTU/cu.ft. - high BTU gas | 570 |
| BTU/gal - gasoline: | 124,575 |

By varying the process conditions wide flexibility can be realized with various grades of solid fuels usable and the product gases and liquid fuels variable in yields and/or quality.

Additionally, by utilizing fibrous solid wastes such as paper, wood and the like as a portion or all of the solid fuel feed, the requirements for air or oxygen feed to the solids reactor is reduced substantially. Energy requirements for steam generation are substantially lowered by the use of chemically produced steam resulting from the coal hydrogenation, hot cobalt treating within the system. Further, the decarbonated, powdered ash recovered from the system is an active ash which can be used in dry or aqueous form in other industries.

Such process as has been described hereinbefore can be operated on a continuous basis and is preferably operated on a continuous basis.

In a general manner, while there has been disclosed an effective and efficient embodiment of the invention, it should be well understood that the invention is not limited to such embodiment as there might be changes made in the arrangement, disposition, and form of the parts without departing from the principle of the present invention as comprehended within the scope of the accompanying claims.

I claim:

1. A process for the production of gaseous and liquid fuels from solid fuel sources which comprises:

1. subjecting said solid fuel to oil extraction and hydrogenation in an oil extractor at a temperature of from about 500° to about 900° F;
2. removing top vent gases from said oil extractor to a cobalt oxide treater, removing hydrogen sulfide therefrom by reaction with said cobalt oxide to form cobalt sulfide, and recovering desulfurized low heat content gaseous fuel;
3. reacting the cobalt sulfide with steam and air to produce elemental sulfur and regenerate cobalt sulfide;
4. removing said elemental sulfur;
5. removing solids-oil slurry from said oil extractor to a hydrocracker, reducing high molecular weight compounds to lower molecular weight compounds therein;
6. removing the hydrocracked solids-oil slurry to a solids reactor, admixing said slurry with hot recirculating sand at a temperature of from about 900° to about 1300° F in a downward flow, producing high heat content gaseous fuel and vaporized gasoline and diesel fuels therein;
7. separating said gaseous and vaporized fuels;
8. hydrogenating and recycling said diesel fuel to said oil extractor;
9. recovering said gasoline fuel;
10. recycling a portion of said high heat content fuel gas to the diesel hydrogenator, desulfurizing and recovering the remainder as product;
11. removing ash from said solids reactor;
12. separating solid alkali metals therefrom;
13. decarbonizing said sand in said solids reactor with air, removing carbon dioxide, carbon monoxide and hydrogen therefrom during said decarbonization; and
14. recycling said sand and said carbon dioxide to said solids reactor.

2. The process as defined by claim 1 wherein the solid fuel is coal.

3. The process as defined by claim 1 wherein the solid fuel is a fibrous organic fuel.

4. The process as defined by claim 1 wherein the solid fuel is shale.

5. The process as defined by claim 1 wherein the oil extractor contains a catalytic amount of cobalt sulfide.

6. The process as defined by claim 1 wherein the process is a continuous process.

* * * * *